US006621984B2

(12) United States Patent
Castañeda et al.

(10) Patent No.: US 6,621,984 B2
(45) Date of Patent: Sep. 16, 2003

(54) IN-LINE FLUID HEATING SYSTEM

(75) Inventors: Hector Joel Castañeda, Lynwood, CA (US); Edward Ramsis Attia, Arcadia, CA (US); Jose Luis Tlaxca, Gardena, CA (US)

(73) Assignee: Integrated Circuit Development Corp., Arcadia, CA (US)

( * ) Notice: Subject to any disclaimer, the term of this patent is extended or adjusted under 35 U.S.C. 154(b) by 0 days.

(21) Appl. No.: 10/211,618

(22) Filed: Aug. 2, 2002

(65) Prior Publication Data

US 2003/0026603 A1 Feb. 6, 2003

Related U.S. Application Data

(60) Provisional application No. 60/310,212, filed on Aug. 3, 2001.

(51) Int. Cl.[7] ..... F24H 1/10
(52) U.S. Cl. ..... 392/483; 392/465
(58) Field of Search ..... 392/465, 480, 392/483

(56) References Cited

U.S. PATENT DOCUMENTS 1,767,122 A * 6/1930 Dean ..... 392/492
5,790,752 A * 8/1998 Anglin et al. ..... 392/483

* cited by examiner

*Primary Examiner*—Thor Campbell
(74) *Attorney, Agent, or Firm*—Kelly Bauersfeld Lowry & Kelley, LLP

(57) ABSTRACT

An in-line fluid heating system including a lamp module having a plurality of heating lamps. A fluid vessel is configured to slidably accept the lamp module therein. The fluid vessel includes a fluid inlet, a fluid outlet, a central tube, and an outer envelope in fluid communication with and coaxial to the central tube. The heating lamp module is removably disposed between the central tube and outer envelope such that the fluid is heated as it passes through the central tube and the outer envelope. A reflector substantially surrounds the fluid vessel for reflecting energy emitted from the lamp module back into the fluid vessel. Insulation may substantially surround the reflector and fluid vessel to further prevent heat loss.

24 Claims, 5 Drawing Sheets

IN-LINE FLUID HEATING SYSTEM

RELATED APPLICATION

This application claims priority from U.S. Provisional Application No. 60/310,212 filed Aug. 3, 2001.

BACKGROUND OF THE INVENTION

The present invention relates to heater systems. More particularly, the present invention relates to in-line fluid heater systems used to heat ultra pure fluids, such as water and aggressive process chemistries.

The art of heating ultra pure water and other aggressive process chemistries for use in the semiconductor, solid state, disk drive, and other process sensitive industries is well known. The performance of such process fluids improves when they are used at higher temperatures. The target temperature for heating systems in this area has been 200° C.

There are already many conventional designs for process fluid heating systems utilizing heat sources such as resistive metal elements, halogen infrared light, or process heat exchangers. Such systems have several drawbacks. Many of these systems are limited in the proximity to which they can place the element in relation to the medium being heated.

One prior art heating system uses a type of resistive ceramic material that radiates heat when electricity is applied. This type of system requires specialized controls to operate the heater. The heating element itself is also thermally sensitive in that rapid heating or cooling of the element can damage it. This type of system will then experience poor performance with a system that has slow response to heating requirements. In practice, this leads to high failure rates for this type of heating system and expensive repair costs.

Another example of a heating system that is intended to meet the needs of the above-mentioned processes utilizes halogen lamps that emit short to medium wave infrared radiation which is exposed to the fluid. By nature, it is difficult to utilize all of the infrared energy emitted by this type of system. FIG. 1 illustrates such a heating system 10. Fluid 12 to be heated passes through a tube 14. A halogen lamp 16, or the like, is placed adjacent to the tube 14 for emitting short to medium wave infrared radiation into the fluid 12. As an improvement, a reflector 18 is disposed around the halogen lamp 16 such that the radiation emitted away form the tube 14 is reflected back into the system 10.

Such a heating system is described in U.S. Pat. No. 5,790,752 to Anglin et al. In the Anglin et al. heating system, lamps are placed around the outside of a fluid vessel, or tube, through which the fluid flows. The fluid tube is preferably transparent to infrared radiation. Due to the fact that the majority of the infrared radiation originating from the lamps are not directed at the fluid to be heated, the design relies upon reflectors to capture and redirect a portion of this lost energy. While this provides some improvement and increases sufficiency somewhat, not all of the energy is captured and some is lost in the reflector itself as heat. The reflectors are typically gold-plated reflectors, increasing the expense of the system. Also, due to the fact that the radiant energy is reflected onto the halogen lamps, the lamps must continually be replaced. In many systems, lamp replacement is not an easy task and requires considerable labor, increasing the operational costs of the system.

Accordingly, there is a need for a heating system with rapid response, lower operational costs, and greater reliability, while also maintaining the ultra-purity required by the above-mentioned processes. The present invention fulfills these needs and provides other related advantages.

SUMMARY OF THE INVENTION

The present invention resides in a heating system comprising a heater assembly having a lamp module and a fluid vessel whereby the lamp module heats a fluid within the fluid vessel. The lamp module produces heat by dissipating electrical energy via a plurality of lamps, such as infrared emitting lamps. The lamps are integrated as part of a lamp module which simplifies the replacement procedure for the lamps.

The in-line fluid heating system of the present invention generally comprises a lamp module including a plurality of heating lamps spaced from one another. A fluid vessel has a fluid inlet and outlet so as to pass fluid therethrough. The fluid vessel is configured to slidably accept the lamp module therein. In a particularly preferred embodiment, the fluid vessel comprises a central tube defining the inlet in fluid communication with an outer envelope coaxial to the central tube and defining the outlet. The lamp module is generally cylindrical and removably disposed between the central tube and the outer envelope. Thus, the fluid is heated as it passes through the central tube and the outer envelope.

The fluid vessel is preferably comprised of a durable and transparent material, such as quartz. In a particularly preferred embodiment, a reflector substantially surrounds the fluid vessel for reflecting energy back into the fluid vessel. Insulation may surround the reflector and fluid vessel to further retain heat within the fluid vessel.

A corrosion resistant housing, such as one comprised of a fluorocarbon plastic, sealingly surrounds the insulation, reflector, fluid vessel and lamp module. Preferably, sensors are associated with the fluid vessel and lamp module for detecting temperature and any fluid leaks of the pressurized fluid in the fluid vessel.

Other features and advantages of the present invention will become apparent from the following more detailed description, taken in conjunction with the accompanying drawings which illustrate by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
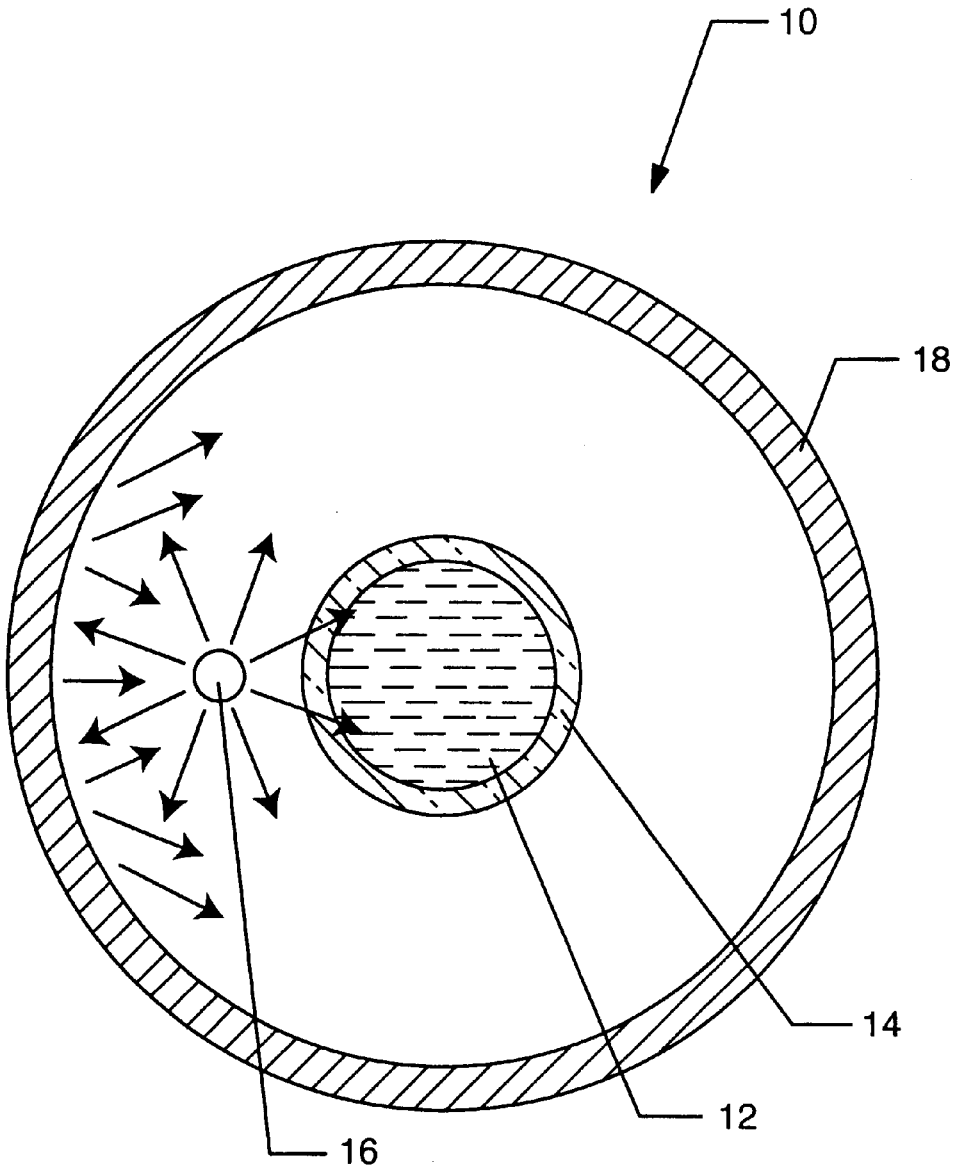
FIG. 1 PRIOR ART
FIG. 1 is a cross-sectional view of a prior art in-line fluid heating system.

As shown in the drawings for purposes of illustration, the present invention is concerned with a heating system, generally shown in FIGS. 2–5 and referred to by the reference number 100. The heating system 100 is generally comprised of a heater assembly 102 and a system housing 104 which supports and houses the heater assembly 102 so as to seal the heater assembly 102 from the outer environment and potential contaminants.

Figure 3:
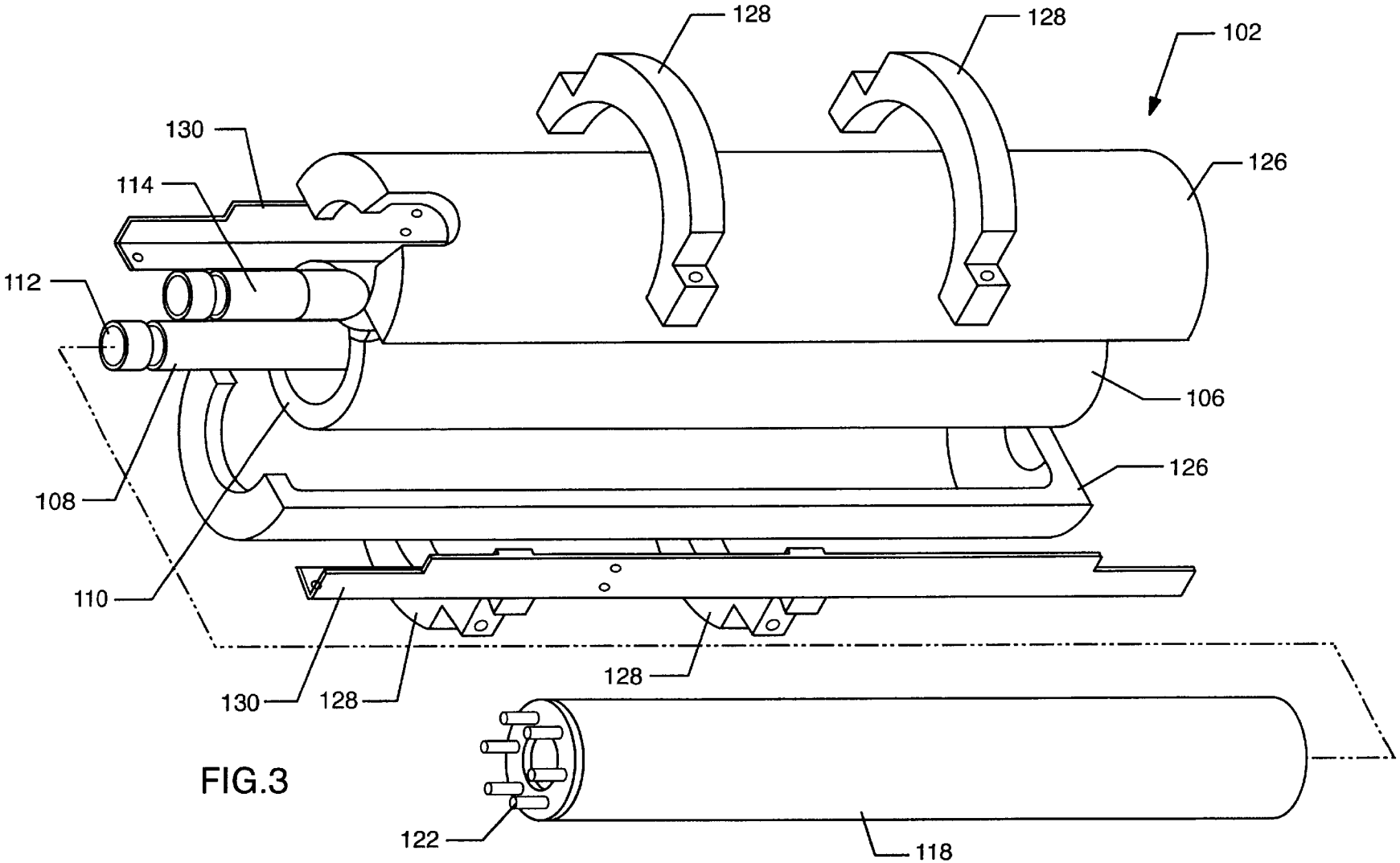
FIG. 3 is an exploded perspective view of a lamp module and fluid vessel used in accordance with the present invention.
Figure 5:
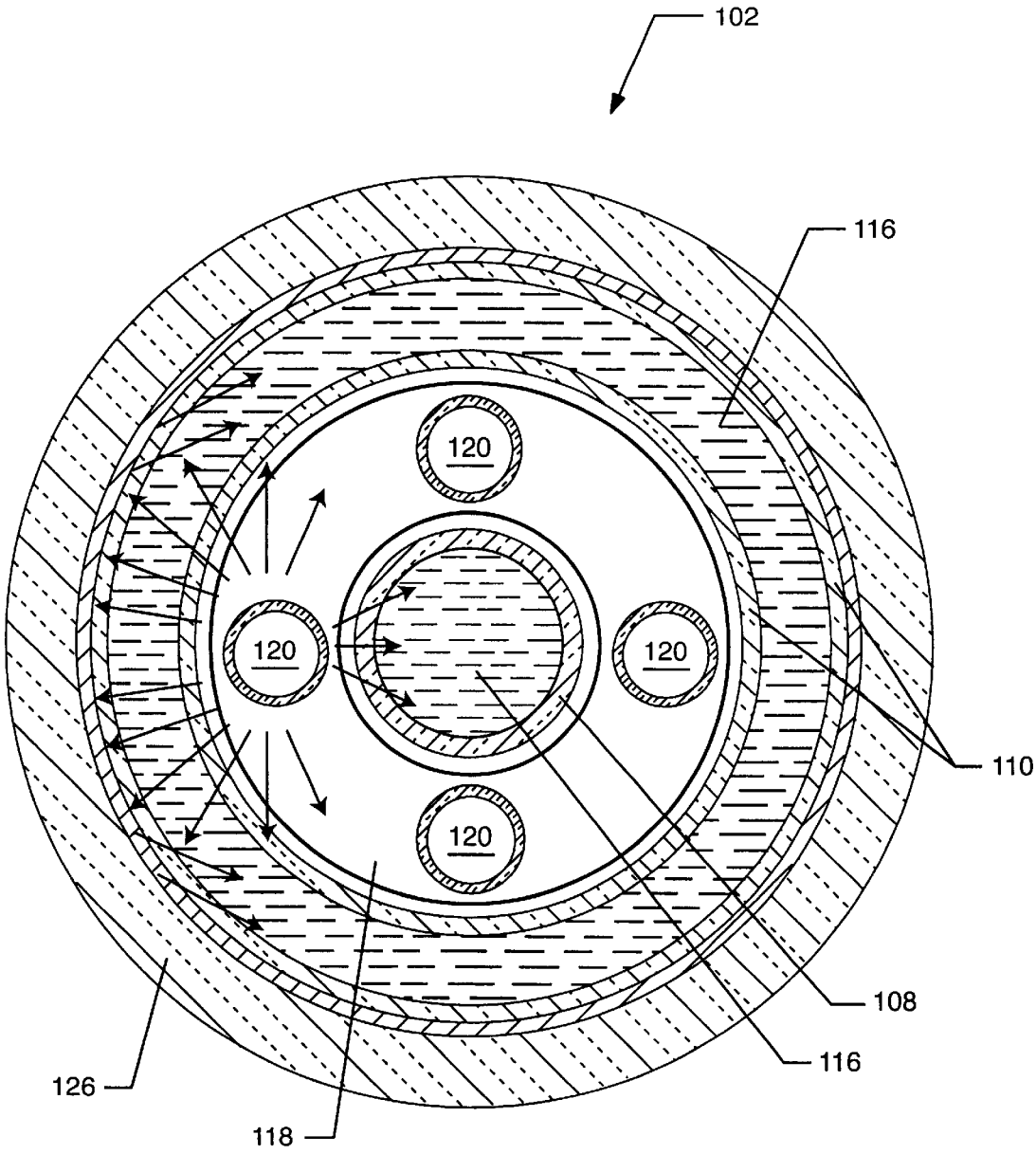
FIG. 5 is a cross-sectional view taken generally along line 5—5 of FIG. 4, illustrating maximum use of heat energy generated by lamps of the system of the present invention.

Referring to FIGS. 3 and 5, the heater assembly 102 includes a fluid vessel 106 preferably comprised of a semiconductor grade ultra pure quartz. Using traditional glass blowing techniques, the fluid vessel 106 is configured to form a central tube 108 and a concentric envelope 110 in fluid communication with one another. The opening 112 of the central tube 108 serves as a fluid inlet, and a fluid outlet 114 is formed on the outer envelope 110 such that fluid enters central tube 108 and travels therethrough and reverses flow and travels through the outer envelope 110 before exiting the heater assembly 102 through outlet 114. Of course, the fluid flow could be reversed while achieving the same benefits described herein. Typically, the process fluid, such as ultra pure water and aggressive process chemistries, are pressurized. The fluid vessel 106 also uses semiconductor grade ultra pure quartz wetted surfaces and ultra pure quartz to Teflon® transition fittings whereby the fluid 116 within the fluid vessel 106 does not become contaminated by the exposure to the environment, or undesirable media.

The fluid vessel 106 is configured to receive a lamp module 118. The lamp module, as illustrated in FIG. 3, is typically a cylindrical quartz envelope fabricated from semiconductor grade ultra pure quartz using traditional glass blowing techniques. It is configured to contain a plurality of lamps 120, typically spaced apart from one another, as shown in FIG. 5. An exposed portion of the lamp 120 forms an electrical terminal 122 whereby the lamp 120 may be connected to a power supply. The lamps 120 create heat by dissipating electrical energy as infrared energy. Preferably, three or four lamps 120 are in a spaced arrangement, such as illustrated in FIG. 5. The lamps 120 are integrated into the lamp module 118 such that they can be replaced easily as a unit. The cylindrical envelope and terminal studs 122 of the lamp module 118 are attached and sealed using pressure welding and ceramic adhesive bonding.

Typically, as illustrated in FIG. 3, the lamp module 118 is placed over central tube 108 of the fluid vessel 106 by sliding the hollow cylindrical lamp module 118 over tube 108 and into the hollow center of the fluid vessel 106 between the outer envelope 110 and inner tube 108. The fluid vessel 106 is configured such that when the lamp module 118 is inserted into the fluid vessel 106, the lamps 120 are in close proximity to the fluid 116 within the central tube 108 and outer cylindrical envelope 110, whereby the fluid 116 will absorb the infrared energy being emitted from the lamp module 118 and also serve to cool the lamps 120 within the lamp module 118 without actually contacting the lamp module 118. As the fluid 116 completely surrounds the lamp module 118, it acts as a heat sink to keep the lamps 120 cooler, effectively prolonging the operational life of the lamps 120.

Placement of the lamp module 118 within the fluid vessel 106 such that the lamp module 118 is substantially surrounded by the fluid vessel 106 provides 360° of directional radiating heat into the process fluid 116 without any contact between the lamp module 118 heat source and the process fluid 116. The configuration also gives two saturations of energy to the process fluid 116 as it moves through the fluid vessel 106 as the fluid path is doubled and the exposure to the infrared energy is prolonged.

The heater assembly 102 also includes a reflector 124 substantially surrounding the fluid vessel 106 for reflecting energy back into the fluid vessel 106. In a particularly preferred embodiment, the reflector 124 comprises a reflective coating on the outer surface of the fluid vessel 106, whereby the infrared energy that has been emitted from the lamp module 118 can be redirected back into the fluid vessel 106 if the infrared energy reaches the outer layer of the fluid vessel 106 without being absorbed, thereby increasing efficiency. Utilization of the reflective coating 124 which is in direct physical contact with the fluid vessel 106 allows any infrared energy loss to the reflector 124 as heat to be returned to the fluid vessel 106 as conductive heat.

In a particularly preferred embodiment, insulation 126 substantially surrounds the reflector 124 and fluid vessel 106 so that heat escaping the reflective layer 124 is absorbed and directed back into the fluid vessel 106, thereby further increasing efficiency. The insulation 126 may comprise an insulation jacket, as illustrated in FIG. 3, that is fitted to the fluid vessel 106.

The combined effects of the configuration of the fluid vessel 106, lamp module 118, reflector 124 and insulation 126 maximizes the heat transfer, removes the need of a nitrogen purge, and allows the unit to maintain processed temperatures of 180° C., while keeping the surface of the assembly 102 cool. Also, due to the fact that the lamp module 118 is slidably received within the fluid vessel 106, in the event that there is lamp 120 failure in the lamp module 118, the entire lamp module 118 can be easily removed from the heater assembly 102 and replaced, reducing maintenance procedures and costs.

The heater assembly 102 is held together with mounting brackets 128. The mounting brackets 128 are further connected to mounting plates 130 which are configured to hold the heater assembly 102 together and mount it within the system housing 104. The heater assembly 102 may also have a plurality of safety devices attached thereon, including, but not limited to, over-temperature sensors, fluid leak sensors, and fluid level sensors.

Figure 2:
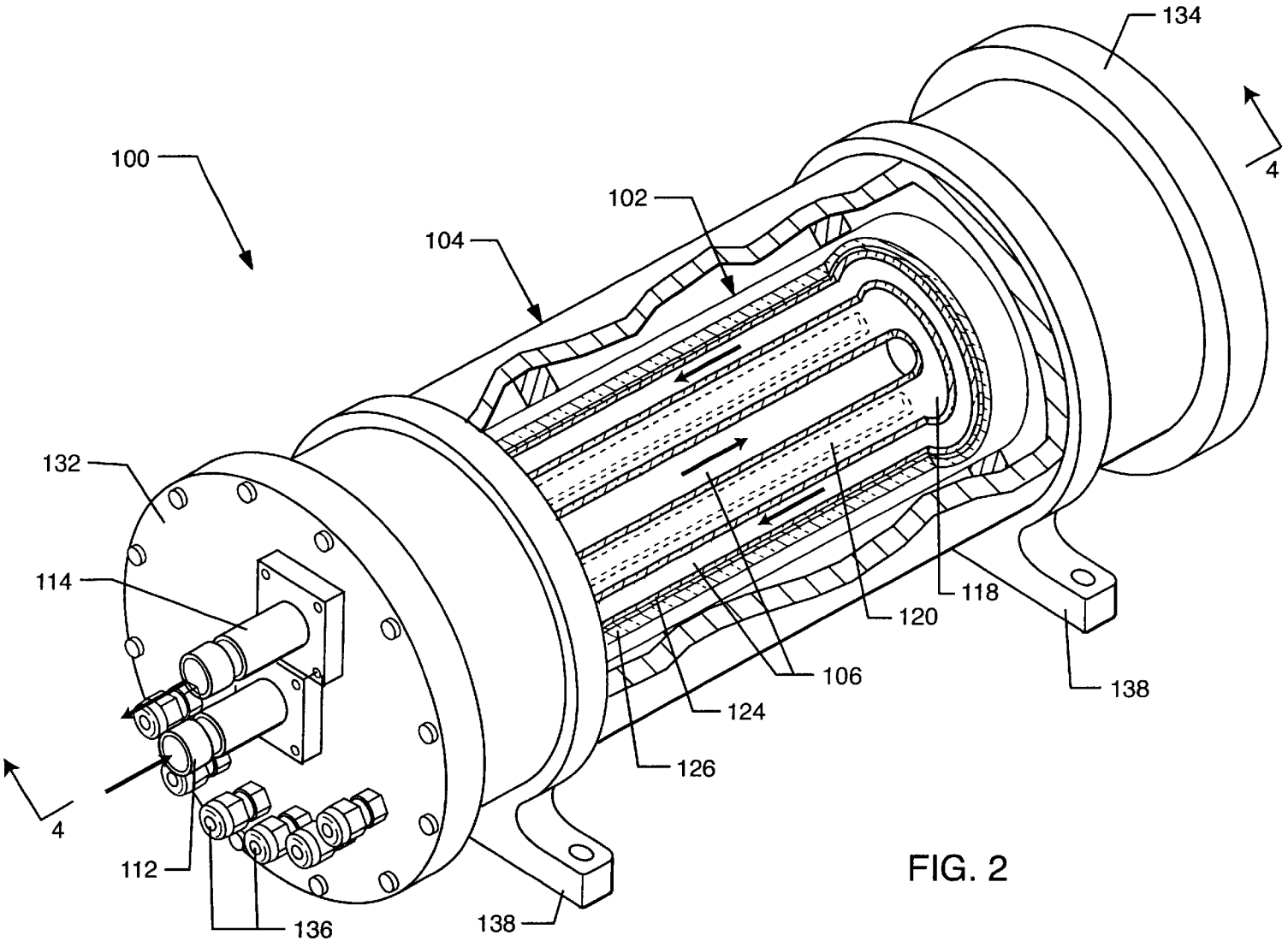
FIG. 2 is a fragmented and partially sectioned perspective view of an in-line fluid heating system embodying the present invention.
Figure 4:
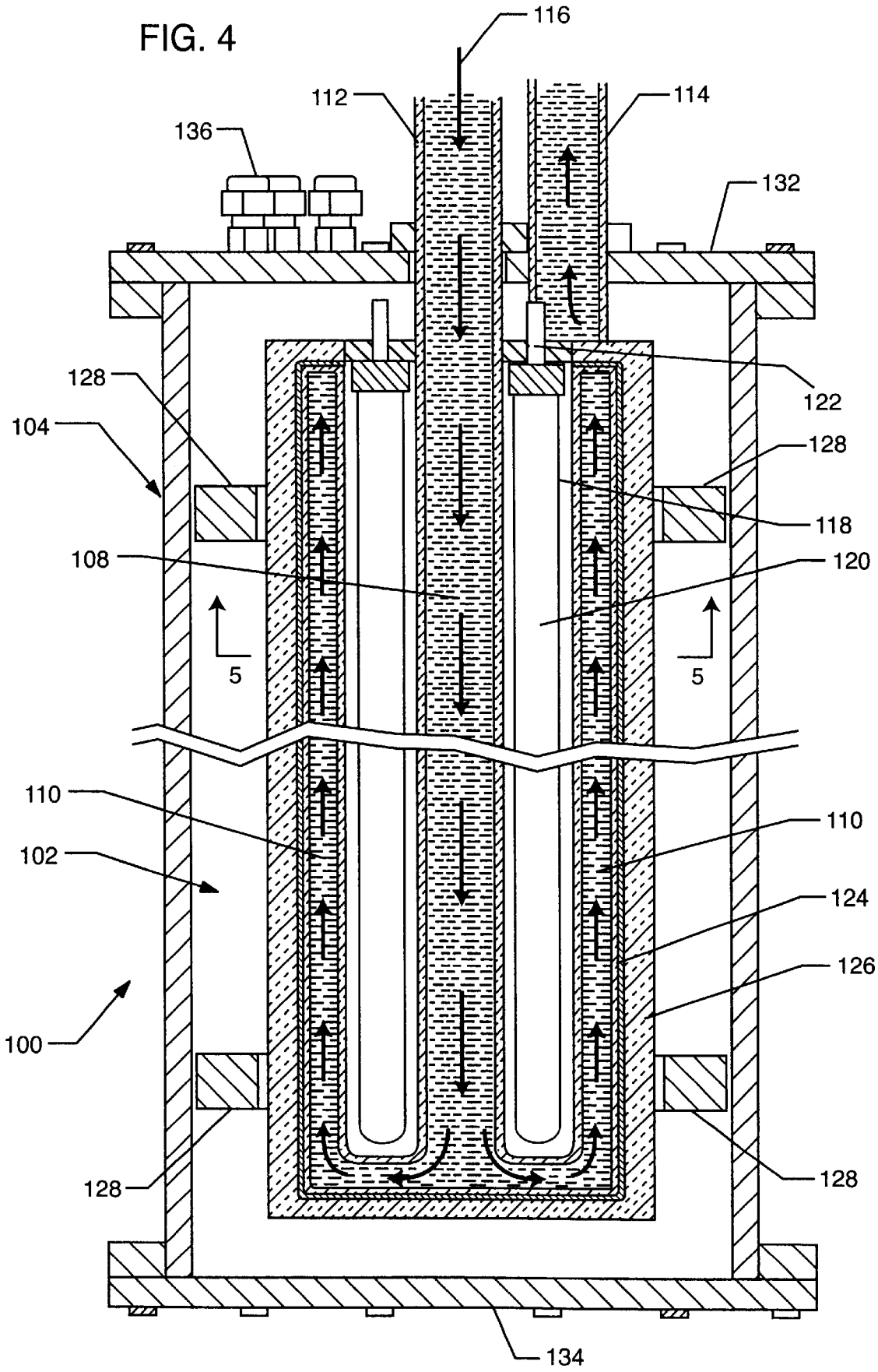
FIG. 4 is a cross-sectional view taken generally along line 4—4 of FIG. 2, illustrating the flow of fluid through the heating system of the present invention.

With reference to FIGS. 2 and 4, the heater assembly 102 is illustrated as being mounted within the system housing 104. The system housing 104 forms a cylindrical enclosure that is preferably fabricated from flouroplastic materials that are capable of withstanding high temperatures and aggressive chemistry. Preferably, the system housing 104 is fabricated from PTFE or PTFM Teflon® materials. This prevents any metal exposure, prolonging the life of the system 100 and making the system 100 ideal for operating in a clean room environment. The system housing 104 is closed at both ends by a pair of end plates 132 and 134. The end plates 132 and 134 are compression sealed such that no foreign material or fluid can enter or exit the system housing 104. A plurality of exit ports 136 extend through an end cap 132 or 134, whereby electrical lead wires, sensor lead wires, etc. may exit the system housing 104.

As shown in FIG. 2, the system housing 104 preferably also includes mounting attachments 138, whereby the heating system 100 can be mounted to a surface. The heating system 100 can be installed either horizontally or vertically to accommodate location and process requirements. The present invention also contemplates using more than one heater assembly 102 within the heating system 100. Additionally, if large amounts of fluid need to be heated, a plurality of heating systems 100 can be plumbed together to provide more heating capability. The plumbed heating systems 100 can also be configured to use three-phase electrical power in order to lower the amperage requirements, thereby reducing operation costs for the end user. Power output can also be increased by increasing the number of lamps 120 per lamp module 118.

It will be appreciated by one skilled in the art that the present invention provides an in-line fluid heating system 100 having many benefits and advantages over those of the prior art. The heating system 100 provides a rapid response, lower operational costs and reliability, while also maintaining the ultra purity required by process sensitive industries, such as the semi-conductor, solid state and disk drive industries. The present invention preferably includes heating lamps 120 capable of withstanding temperatures in excess of 200° C., and which can be heated from ambient to 300–400° C. and back to ambient without damaging the lamps 120. The improved stability of the lamps 20 allows the heater system 100 to have a faster response time. Also, the heater lamps 120 of the present invention are cooled by the surrounding fluid in the fluid vessel 106, and thus typically lasts much longer than traditional halogen lamps, thereby reducing operation and repair costs. Of particular importance to the present invention is the maximization of heat transfer from the lamp module 118 to the fluid 116 within the fluid vessel 106, as described above.

Although several embodiments have been described in detail for purposes of illustration, various modifications may be made without departing from the scope and spirit of the invention. Accordingly, the invention is not to be limited, except as by the appended claims.

What is claimed is:

1. An in-line fluid heating system, comprising:

a fluid vessel defining a fluid inlet, a fluid outlet, a central tube and an outer envelope in fluid communication with and coaxial to the central tube; and a lamp module including at least one heating lamp disposed between the fluid vessel central tube and outer envelope for heating the fluid as it passes through the central tube and the outer envelope.

2. The system of claim 1, wherein the lamp module is removably disposed between the central tube and outer envelope of the fluid vessel.

3. The system of claim 1, wherein the lamp module is generally cylindrical and includes multiple heating lamps spaced from one another.

4. The system of claim 1, wherein the fluid vessel is comprised of a durable and transparent material.

5. The system of claim 4, wherein the fluid vessel is comprised of a quartz material.

6. The system of claim 1, including a reflector substantially surrounding the fluid vessel for reflecting energy back into the fluid vessel.

7. The system of claim 1, including insulation substantially surrounding the fluid vessel.

8. The system of claim 7, including a corrosion resistant housing sealingly surrounding the insulation, fluid vessel and lamp module.

9. The system of claim 8, wherein the housing is comprised of a fluorocarbon plastic.

10. The system of claim 1, wherein the fluid passing through the fluid vessel is under pressure.

11. The system of claim 1, including sensors associated with the fluid vessel and lamp module for detecting temperature or fluid leaks.

12. An in-line fluid heating system, comprising: a lamp module including a plurality of heating lamps, a fluid vessel having a fluid inlet and fluid outlet so as to pass fluid therethrough, the vessel being configured to slidably receive the lamp module therein, and a reflector substantially surrounding the fluid vessel for reflecting energy emitted from the lamp module back into the fluid vessel, the fluid vessel further comprising a central tube defining the inlet in fluid communication with an outer envelope coaxial to the central tube and having the outlet, and wherein the lamp module is removably disposed between the central tube and the outer envelope, whereby fluid is heated as it passes through the central tube and the outer envelope.

13. The system of claim 12, wherein the lamp module is generally cylindrical and includes multiple heating lamps spaced from one another.

14. The system of claim 12, wherein the fluid vessel is comprised of a quartz material.

15. The system of claim 12, including insulation substantially surrounding the reflector and fluid vessel.

16. The system of claim 15, including a corrosion resistant housing sealingly surrounding the insulation, fluid vessel and lamp module.

17. The system of claim 16, wherein the housing is comprised of a fluorocarbon plastic.

18. The system of claim 12, including sensors associated with the fluid vessel and lamp module for detecting temperature or fluid leaks.

19. An in-line fluid heating system, comprising:

a generally transparent fluid vessel configured to pass pressurized fluid therethrough and defining a fluid inlet, a fluid outlet, a central tube and an outer envelope in fluid communication with and coaxial to the central tube;

a lamp module removably disposed between the central tube and outer envelope of the fluid vessel and including a plurality of heating lamps for heating the fluid as it passes through the central tube and the outer envelope;

a reflector substantially surrounding the fluid vessel for reflecting energy back into the fluid vessel; and insulation substantially surrounding the fluid reflector and fluid vessel.

20. The system of claim 19, wherein the lamp module is generally cylindrical and includes multiple heating lamps spaced from one another.

21. The system of claim 19, wherein the fluid vessel is comprised of a quartz material.

22. The system of claim 19, including a corrosion resistant housing sealingly surrounding the insulation, fluid vessel and lamp module.

23. The system of claim 19, including sensors associated with the fluid vessel and lamp module for detecting temperature or fluid leaks.

24. An in-line fluid heating system, comprising:

a generally transparent fluid vessel configured to pass pressurized fluid therethrough and defining a fluid inlet, a fluid outlet, a central tube and an outer envelope in fluid communication with and coaxial to the central tube, wherein the fluid vessel is comprised of a quartz material;

a generally cylindrical lamp module removably disposed between the central tube and outer envelope of the fluid vessel wherein the lamp module includes a plurality of heating lamps for heating the fluid as the fluid passes through the central tube and the outer envelope, wherein the heating lamps are spaced from one another;

a reflector substantially surrounding the fluid vessel for reflecting energy back into the fluid vessel;

insulation substantially surrounding the reflector and the fluid vessel;

a corrosion resistant fluorocarbon plastic housing sealingly surrounding the insulation, fluid vessel and lamp module; and sensors associated with the fluid vessel and lamp module for detecting temperature or fluid leaks.

* * * * *